US005492001A

United States Patent [19]

Sasaki et al.

[11] Patent Number: 5,492,001

[45] Date of Patent: Feb. 20, 1996

[54] METHOD AND APPARATUS FOR WORKING BURRED PORTION OF WORKPIECE

[75] Inventors: Zirou Sasaki, Hamamatsu; Masuhiro Yamamoto, Hamakita; Norio Gotoh, Iwata, all of Japan

[73] Assignee: Kabushiki Kaisha Yutaka Giken, Shizuoka, Japan

[21] Appl. No.: 183,413

[22] Filed: Jan. 18, 1994

[51] Int. Cl.[6] ..... B21D 22/00; B21D 28/00; B21D 28/16

[52] U.S. Cl. ..... 72/359; 72/355.2; 72/354.6; 72/327; 72/333

[58] Field of Search ..... 72/335, 336, 344, 72/355.2, 355.4, 354.6, 359, 327, 328, 333, 334

[56] References Cited

U.S. PATENT DOCUMENTS

| | | | |
|---|---|---|---|
| 175,653 | 4/1876 | Bliss | 72/345 |
| 3,513,683 | 5/1970 | Moore | 72/355.4 |
| 4,389,871 | 6/1983 | Takeuchi et al. | 72/355.4 |
| 4,604,886 | 8/1986 | McGregor, Jr. | 72/355.4 |
| 4,611,391 | 9/1986 | Franz et al. | 72/355.4 |

FOREIGN PATENT DOCUMENTS

| | | |
|---|---|---|
| 62-214834 | 3/1986 | Japan . |
| 63-260631 | 4/1987 | Japan . |
| 190943 | 11/1990 | Japan . |

*Primary Examiner*—Lowell A. Larson
*Assistant Examiner*—Rodney Butler
*Attorney, Agent, or Firm*—Armstrong, Westerman, Hattori, McLeland & Naughton

[57] ABSTRACT

The periphery of a workpiece which has already been subjected to burring is at least partially punched by a periphery punch and a periphery die. The burred portion is then further pressed by the periphery punch and a die surface including an annular portion which opposes the periphery punch while restricting the lateral movement of the workpiece by the periphery die. An apparatus for working a burred portion is made up of a metallic mold having a periphery die and a periphery punch, a lifter which is disposed inside the periphery die so as to be movable up and down relative to the periphery die, and further working device for further working the burred portion into a shape and dimension of those of a final product of the workpiece. The further working device includes a pilot pin which is projectingly fixed to a lower end of the periphery punch and a knockout which is disposed in a recess in the lifter and which has an annular portion on its upper edge.

25 Claims, 4 Drawing Sheets

METHOD AND APPARATUS FOR WORKING BURRED PORTION OF WORKPIECE

BACKGROUND OF THE INVENTION

1. Field of the Invention

The present invention relates to a method and an apparatus for working a burred portion, i.e., a portion which is formed into a projecting edge, of a metallic plate. It relates, in particular, to a method and an apparatus for additionally or further working a sheer drop or roll over which occurs in the form of a sink or rounded edge at the base of a burred portion of a relatively thick metallic plate as well as working an irregular surface at a front end of the burred portion.

2. Description of Related Art

An art of further working a metallic plate to make the shape of the burred portion into a desired one is known for example in Japanese Published Unexamined Patent Application No. 260631/1988. In the art disclosed therein, a workpiece made of a relatively thin metallic plate is held in a pinching manner between a die which is urged by a spring and a stopper. A burred portion is formed by means of this die and a punch which is arranged to pass through the stopper. In a condition in which the workpiece, the die, the stopper and the punch are closely held together, the burred portion is pressed against a pressurizing element which is stationarily disposed opposite the burred portion, thereby performing the further working of the burred portion.

In this conventional art, the frictional force to be generated by the urging pressure of the spring is used as a means of holding the workpiece in position. It follows that the workpiece is likely to be moved laterally at the time of correcting or further working the burred portion. This tendency of lateral movement is more conspicuous when a larger pressing force is required for further working a relatively thicker workpiece. As a result, the position of the burred portion relative to the periphery of the workpiece is likely to become inaccurate.

The present invention has an object of providing a method and an apparatus for working a burred portion of a workpiece in which the burred portion which is free from shear drop and is accurate in its front end shape can be formed in a correct position relative to the periphery of a plate or a plane portion, as opposed to the burred portion, of the workpiece.

According to one aspect of the present invention, the foregoing and other objects are attained by a method of working a burred portion comprising the steps of: at least partially punching a periphery of a workpiece, which has already been subjected to burring, by a periphery punch and a periphery die; and further pressing the burred portion by the periphery die and a die surface including an annular portion which opposes the periphery punch while restricting a lateral movement of the workpiece by the periphery die.

In accordance with another aspect of the present invention, the foregoing and other objects are attained by a method of working a burred portion comprising the steps of: feeding into a periphery die a workpiece which has already been subjected to burring and a periphery of which has already been punched into a predetermined dimension; and pressing the burred portion by an upper punch and a die surface including an annular portion which opposes the upper punch while restricting a lateral movement of the workpiece by the periphery die.

In accordance with still another aspect of the present invention, the foregoing and other objects are attained by an apparatus for working a burred portion comprising: a metallic mold having a periphery die and a periphery punch which are arranged to at least partially punch a periphery of a workpiece which has already been subjected to burring; a lifter which is disposed inside the periphery die so as to be movable up and down relative to the periphery die; and further working means for further working the burred portion into a shape and dimension to those of a final product of the workpiece while restricting a lateral movement of the workpiece by the periphery die.

In accordance with a still further aspect of the present invention, the foregoing and other objects are attained by an apparatus for working a burred portion comprising: a metallic mold having a periphery die and an upper punch, the periphery die being arranged such that a workpiece, which has already been subjected to burring and a periphery of which has already been punched into a predetermined dimension, is fed thereinto; a lifter which is disposed inside the periphery die so as to be movable up and down relative to the periphery die; and further working means for further working the burred portion into a shape and dimension of those of a final product of the workpiece while restricting a lateral movement of the workpiece by the periphery die.

Preferably, the further working means comprises a pilot pin which is projectingly fixed to a lower end of the periphery punch or the upper punch; and a knockout which is disposed in a recess in the lifter so as to be movable up and down, the knockout having an annular portion on an upper edge thereof. The pilot pin has an outer diameter substantially equal to an inner diameter of the burred portion and the annular portion has an inner diameter substantially equal to the outer diameter of the pilot pin and a thickness substantially equal to a thickness of the burred portion of the final product. An upper surface of the annular portion is arranged to pressingly receive a front end of the burred portion.

According to still another aspect of the present invention, the foregoing and other objects are attained by an apparatus for working a burred portion comprising: a metallic mold having a periphery die and a periphery punch which are arranged to at least partially punch a periphery of a workpiece which has already been subjected to burring; a lifter which is disposed inside the periphery die so as to be movable up and down relative to the periphery die; and a central member disposed inside the lifter. The central member comprises an upper cylindrical portion for receiving therethrough the burred portion of the workpiece and a peripheral annular portion having an upper flat surface for receiving thereon a front end of the burred portion such that further working of the burred portion can be carried out while restricting a lateral movement of the workpiece by the periphery die.

According to still further aspect of the present invention, the foregoing and other objects are attained by an apparatus for working a burred portion comprising: a metallic mold having a periphery die and an upper punch which are arranged to receive therein a workpiece which has already been subjected to burring and a periphery of which has already been punched into a predetermined dimension; a lifter which is disposed inside the periphery die so as to be movable up and down relative to the periphery die; and a central member disposed inside the lifter. The central member comprises an upper cylindrical portion for receiving therethrough the burred portion of the workpiece and a peripheral annular portion having an upper flat surface for receiving thereon a front end of the burred portion such that further working of the burred portion can be carried out while restricting a lateral movement of the workpiece by the periphery die.

Preferably, the cylindrical portion of the central member has an outer diameter substantially equal to an inner diameter of the burred portion of a final product of the workpiece. The peripheral annular portion has a thickness substantially equal to the thickness of the burred portion of the final product.

According to the above-described method of one aspect of the present invention, since the burred portion is further worked while the periphery of the workpiece is being restricted in its lateral movement by the periphery die, the position of the burred portion relative to the periphery of the workpiece is held constant.

According to the above-described method of another aspect of the present invention, the workpiece which has already been punched in its periphery is fed into the periphery die and the further working of the burred portion is carried out while restricting the lateral movement by the periphery die. Therefore, the position of the burred portion relative to the periphery of the workpiece is also held constant.

By the above-described further working, the radius of curvature of a shear drop which was formed at a base portion of the burred portion is shortened and the front surface thereof is made to a predetermined shape.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

Figure 1A:
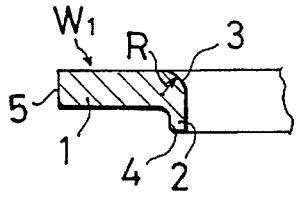
FIGS. 1(*a*) and 1(*b*) show a workpiece in a first embodiment of the present invention, wherein FIG. 1(*a*) is the workpiece before further working and FIG. 1(*b*) is the workpiece after the further working.
Figure 1B:
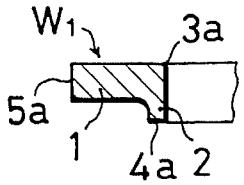
Figure 2:
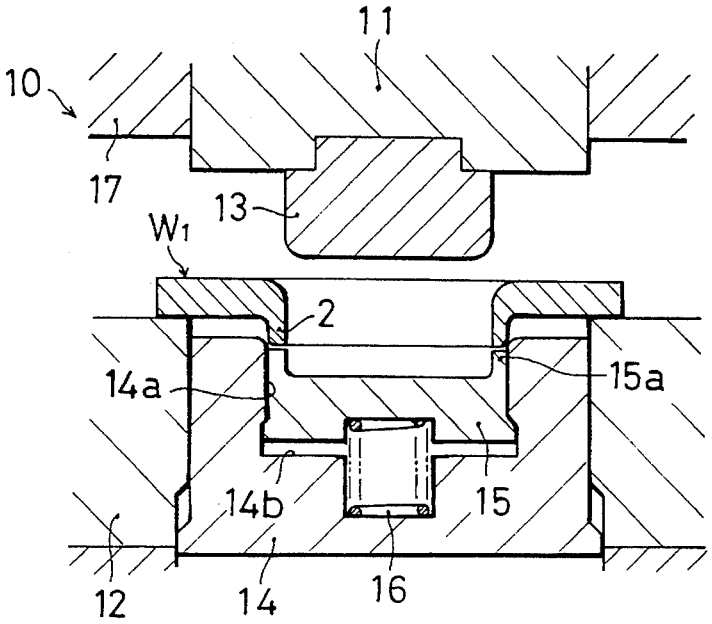
FIG. 2 is a sectional view of an apparatus for carrying out the above-mentioned first embodiment.
Figure 3:
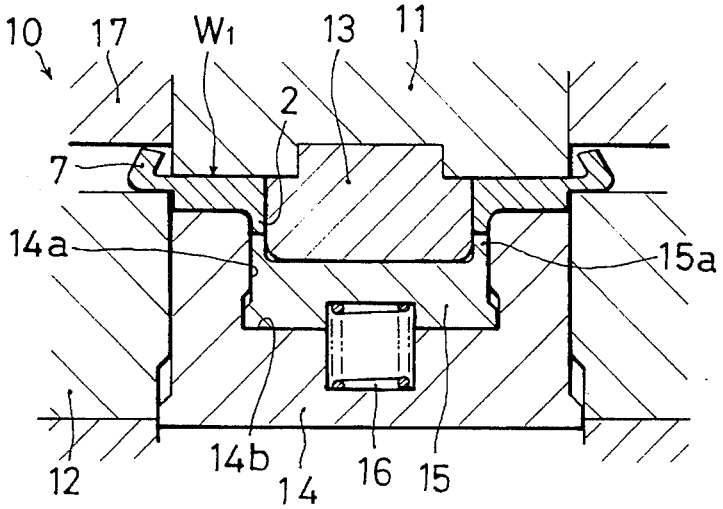
FIG. 3 is a sectional view of the apparatus while it is further working the workpiece.

FIGS. 1(*a*) and 1(*b*), FIG. 2 and FIG. 3 show a first embodiment of an apparatus for carrying out the method of working a burred portion of a workpiece according to the present invention. FIG. 1(*a*) shows a workpiece $W_1$ before the above-described working and FIG. 1(*b*) shows the workpiece $W_1$ after the above-described working. The workpiece $W_1$ in FIG. 1(*a*) has formed therein a sheer drop or roll over 3 in the form of a sink or rounded edge of relatively large radius of curvature R at the bottom of the burred portion 2, which is formed in a previous step of burring, so as to rise or extend perpendicularly from a plate 1. At the front end 4 of the burred portion 3, there is formed an irregular surface. The periphery 5 of the plate 1 at this stage has not been worked yet. This workpiece $W_1$ is subjected to further working by means of a metallic mold 10 shown in FIGS. 2 and 3 so as to form a sharp edge portion 3*a*, a flat front end 4*a* and an accurate periphery 5*a* as shown in FIG. 1(*b*).

The metallic mold 10 is provided with a punch 11 and a die 12 both of which are for completely forming or partly forming the periphery by at least partly punching the plate 1 or plane portion of the workpiece $W_1$ (hereinafter called a periphery punch 11 and a periphery die 12, respectively). In the center of the periphery punch 11 there is fixed a pilot pin 13 in a downwardly projecting manner. Inside the periphery die 12 there is disposed, in a vertically movable manner, a lifter 14 which receives the workpiece $W_1$ and lifts it. A knockout 15 is inserted into the lifter 14 so as to be seated on the bottom surface 14*b* of the central recess 14*a* of the lifter 14. A ring portion or annular portion 15*a* of the knockout 15 is arranged to be positioned in an annular space to be formed by the lifter 14 and the pilot pin 13. The knockout 15 is urged or pressurized upwards by resilient means 16 such as springs, gas dampers, or the like which are disposed at the bottom of the lifter 14. There is further provided a stripper 17 which encloses the periphery of the periphery punch 11 and which detaches or releases a refuse 7 off the periphery punch 11 after punching depending on the process of working.

In operation, the workpiece $W_1$ is disposed on or fed to the periphery die 12 and the periphery punch 11 is lowered. The pilot pin 13 is then first caused to be inserted into a hole formed in the burred portion 2 so that the workpiece $W_1$ is aligned in a correct positional relationship. Thereafter, as shown in FIG. 3, pressing and/or punching of the burred portion of the workpiece $W_1$ will be carried out by the periphery punch 11 and the periphery die 12. If the periphery punch 11 is further lowered, the ring portion 15*a* of the knockout 15 pressingly contacts the front end 4 of the burred portion 2, the spring 16 is compressed and the knockout 15 will be in a condition in which it is seated onto the bottom surface 14*b* of the central recess 14*a*. In the illustrated condition, the workpiece $W_1$ is still in a condition in which the periphery thereof has not been completely punched or cut off.

If the lifter 14 is further lowered together with the periphery punch 11 while the periphery punch 11 is being pressurized towards the lifter 14, the punching or cutting off of the periphery of the workpiece is completed by the periphery punch 11 and the periphery die 12. The workpiece $W_1$ is, at the same time, prevented by the periphery die 12 from moving laterally.

During the above-described step, the pressing of the burred portion 2, i.e., the further working of the workpiece $W_1$, is performed in the following manner. Namely, the burred portion is pushed towards the bottom surface of the periphery punch 11 by the ring portion 15a within the annular space to be formed by the internal surface of the central recess 14*a*, the external surface of the pilot pin 13, the upper surface of the ring portion 15*a* and the lower surface of the periphery punch 11. As a result, the burred portion 2 is pressed so as to fully occupy the annular space, thereby reducing the shear drop 3 and, at the same time, making the front end 4 of the burred portion 2 flat. After this further working has been finished, the periphery punch 11 is retracted, the lifter 14 is lifted and the knockout 15 is caused to be resiliently repelled by the spring 16, thereby discharging the product.

In the above-described operation, the further working by the lifter 14 and the knockout 15 is carried out while the periphery of the workpiece $W_1$ is being pressed or punched. It may, however, be performed at a different timing just after the punching or cutting off of the periphery of the workpiece $W_1$ while holding the workpiece by the periphery die 12. In other words, the punching of the periphery of the workpiece $W_1$ may be done right after the above-described further working of the burred portion 2 or in a separate step after the step of the further working.

Figure 4A:
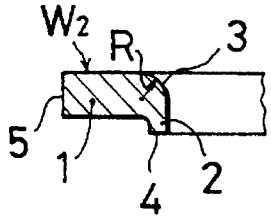
FIGS. 4(*a*) and 4(*b*) show a workpiece in a second embodiment of the present invention, wherein FIG. 4(*a*) is the workpiece before further working and FIG. 4(*b*) is the workpiece after the further working.
Figure 4B:
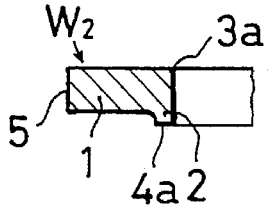
Figure 5:
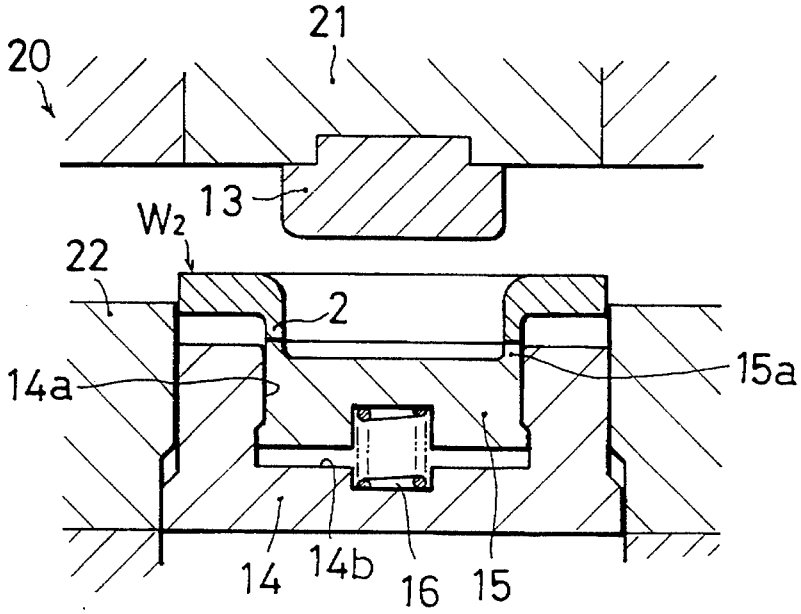
FIG. 5 is a sectional view of an apparatus for carrying out the above-mentioned second embodiment.
Figure 6:
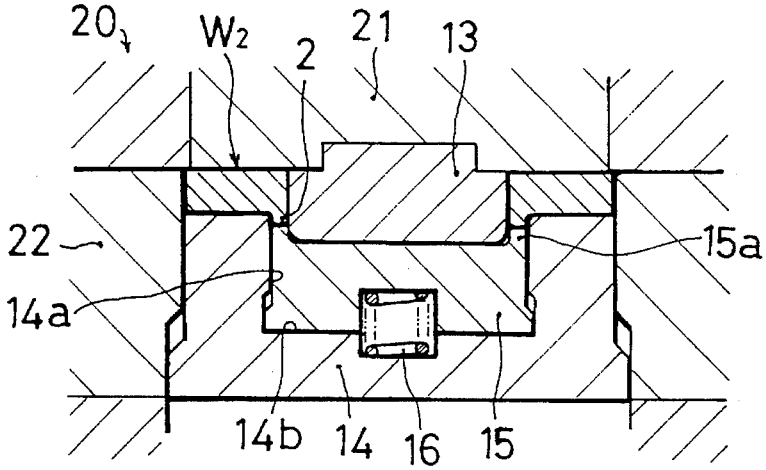
FIG. 6 is a sectional view of the apparatus while it is further working the workpiece.

FIGS. 4 through 6 show a second embodiment of the apparatus for carrying out the method of the present invention. In the Figures, the workpiece $W_2$ has already been punched so that the periphery thereof has predetermined dimensions and a shape. The shear drop 3 and the front end 4 of the burred portion 2 are still not subjected to further working as is the case with the workpiece $W_1$.

The metallic mold 20 of this second embodiment is provided with an upper punch 21 and a periphery die 22. However, this upper punch 21 and the periphery die 22 do not perform the operation of punching the periphery of the workpiece. Like in the first embodiment, there are also provided a pilot pin 13, a lifter 14 and a knockout 15 as shown.

In operation, the punch 21 and the lifter 14 are retracted to a position as shown in FIG. 5. A workpiece $W_2$ is placed in position inside the periphery die 22. By lowering the upper punch 21 as shown in FIG. 6, the pressing is performed by the upper punch 21 and the ring portion **15*a* within the annular space to be formed by the central recess 14*a* of the lifter 14 and the external surface of the pilot pin 13. By thus pressing the burred portion with the upper punch 21 and the annular portion 15*a*, the shear drop 3 and the front end 4** are further worked, thereby obtaining a predetermined product.

Figure 7:
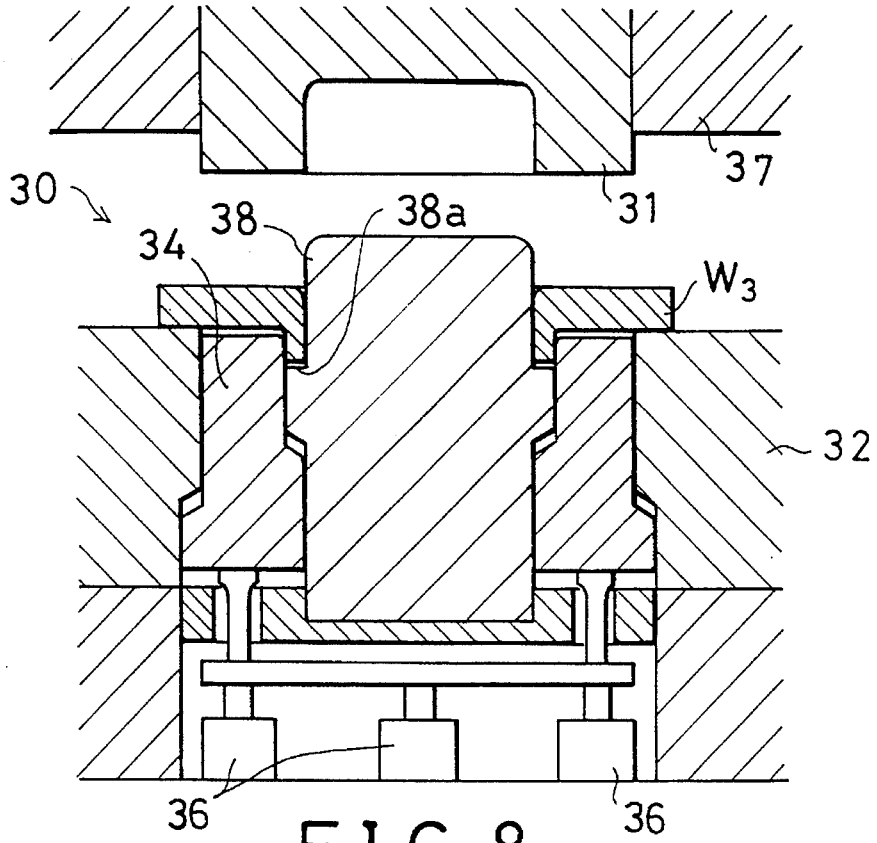
FIG. 7 is a sectional view of an apparatus for carrying out a third embodiment of the present invention.
Figure 8:
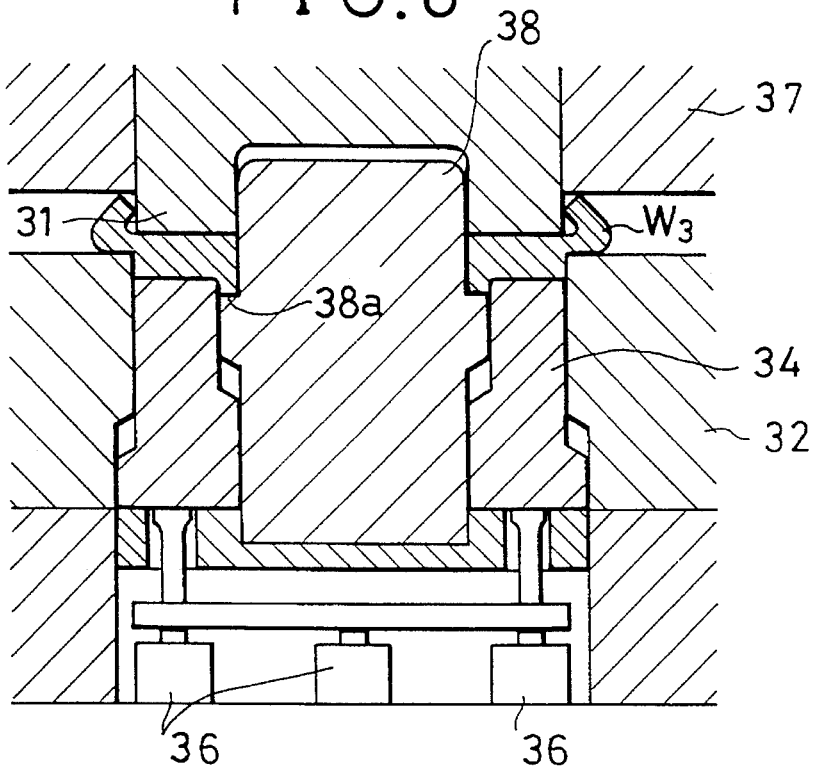
FIG. 8 is a sectional view thereof while it is further working the workpiece.

A third embodiment of the present invention is shown in FIGS. 7 and 8. In this embodiment, a metallic mold 30 is made up of a periphery punch 31 and a periphery die 32. In the center of the periphery die 32, there is disposed a lifter 34 which is movable down against resilient means 36 such as springs, gas dampers as represented by cylinders called NITRO-DYNE (a product of a company TELEDYNE HYSON) or the like. The lifter 34 is provided with a central opening into which a central member 38 is disposed. This central member 38 is provided on its upper end with a cylindrical portion which has an outer diameter substantially equal to an inner diameter of the burred portion of the final product of the workpiece $W_3$ and, towards the lower end of the cylindrical portion, a peripheral annular portion or ring portion **38*a* which extends sidewise and has a flat upper surface for receiving thereon a front end of the burred portion of the workpiece $W_3$. The thickness of the peripheral annular portion 38*a* is made substantially equal to the thickness of the burred portion of the final product. Numeral 37** denotes a stripper.

In operation, the workpiece $W_3$ is placed or fed over the cylindrical portion with a hole of the burred portion passing therethrough, thus aligning the positional relationship of the workpiece $W_3$. The peripheral punch 31 is lowered to press the workpiece $W_3$ such that the burred portion is further worked into the shapeland dimensions of the final product within a space to be formed by the upper surface of the peripheral annular portion **38*a*, an outer surface of the cylindrical portion of the central member 38, an inner surface of the central opening of the lifter 34 and a lower surface of the periphery punch 31**.

In this embodiment, the number of the constituent parts can be decreased as compared with the first embodiment by combining the pilot pin 13 and the knockout 15 of the first embodiment into a single piece in the form of the central member 38. Further, the alignment of the workpiece can be easily done by feeding it onto the cylindrical portion.

In the condition shown in FIG. 8, the punching or cutting off of the periphery of the workpiece $W_3$ has not been completed. In substantially the same manner as in the first embodiment, if an arrangement is made such that the lifter 34 and the central member 38 are capable of further lowering together with the peripheral punch 31, the punching or cutting off of the periphery of the workpiece $W_3$ can be made within the same step right after the further working. It may, of course, be arranged that the punching of the periphery of the workpiece $W_3$ is done separately in the subsequent step.

Figure 9:
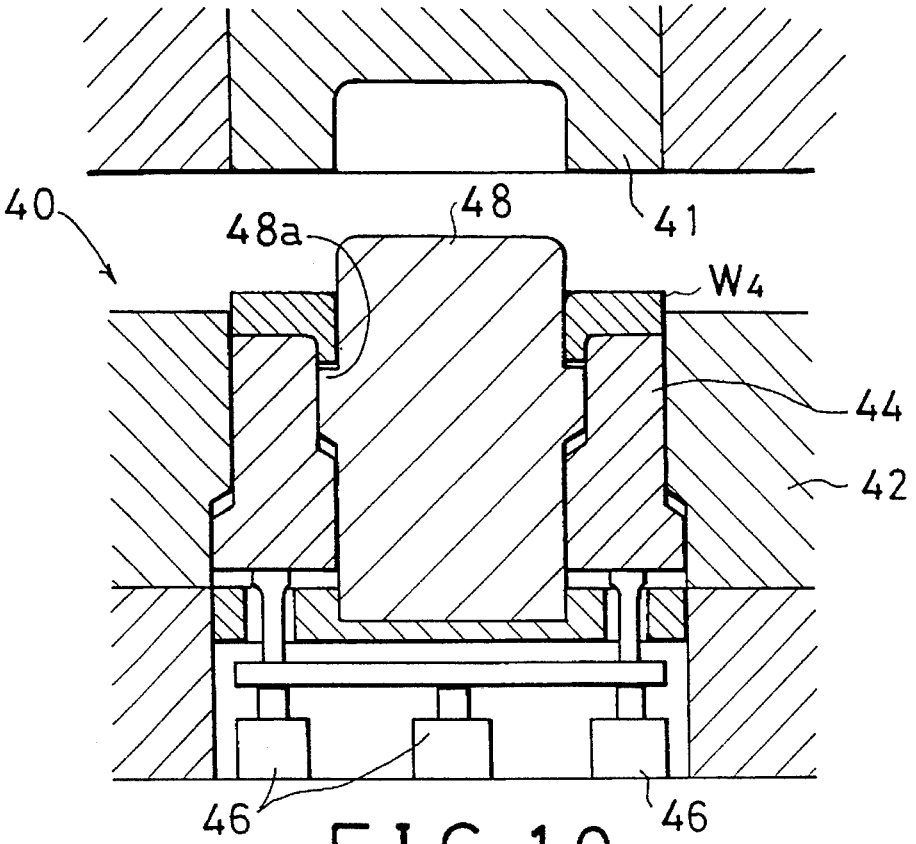
FIG. 9 is a sectional view of an apparatus for carrying out a fourth embodiment of the present invention.
Figure 10:
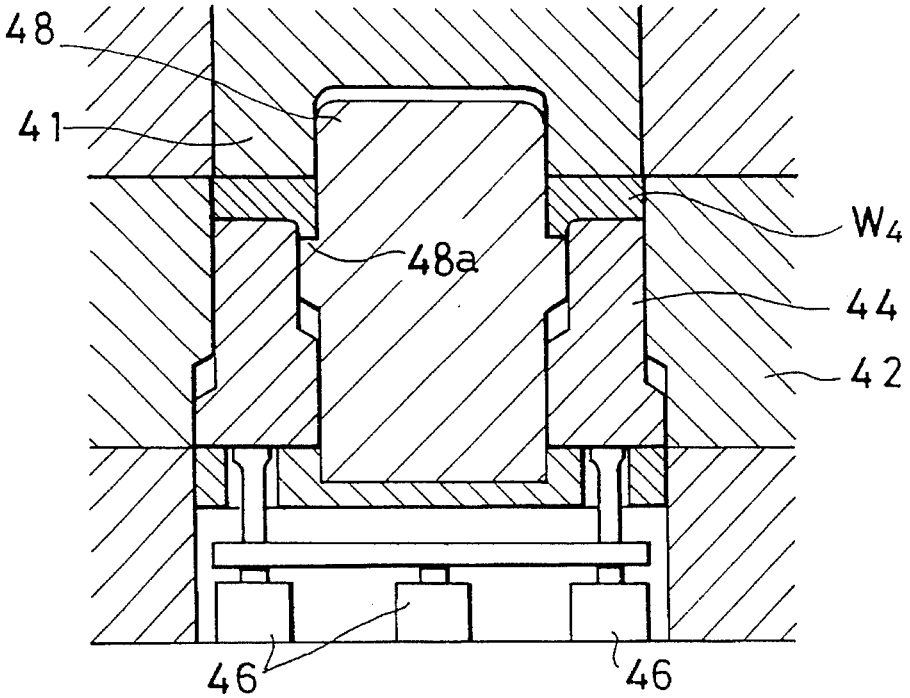
FIG. 10 is a sectional view thereof while it is further working the workpiece.

A fourth embodiment of the present invention is shown in FIGS. 9 and 10. The difference between this embodiment and the third embodiment is that this embodiment is for treating a workpiece which has already been subjected to burring and a periphery of which has already been punched into a predetermined dimension. Namely, an upper punch 41 is used in the fourth embodiment instead of the periphery punch 31 in the third embodiment. Otherwise, the arrangement is substantially the same as that of the third embodiment; other corresponding members are therefore shown with numerals starting with 4 instead of 3 in the fourth embodiment.

In operation, a workpiece $W_4$ which has already been subjected to burring and a periphery of which has already been punched into a predetermined dimension, is placed or fed over the cylindrical portion of the central member 48. The periphery of the workpiece $W_4$ is arranged to be positioned inside the periphery die 42. The upper punch 41 is lowered to press the workpiece $W_4$ such that the burred portion is pressed or further worked into dimensions of a final product of the workpiece $W_4$ substantially in the same manner as in the third embodiment.

As described hereinabove, according to the present invention, the pressing of the burred portion is carried out in a condition in which the lateral movement of the workpiece is being prevented or restricted by the die. Therefore, it has an advantage in that the burred portion which is free from shear drop and is accurate in its front end shape can be formed in a correct position within the workpiece. Further, since the burred portion is not subjected to an excessive force, there is an advantage in that damages such as cracking, inclusion, or the like do not occur.

It is readily apparent that the above-described methods and apparatuses for working a burred portion have the advantages of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A method of shaping a burred portion of a metallic plate, comprising the steps of:

providing a metallic plate having a generally flat upper surface and a central opening within the plate, the central opening having a burred portion therearound and extending transverse to the generally flat upper surface, and the burred portion having a rounded edge (3) at a base of the burred portion which connects to the flat upper surface;

providing a periphery die which has an inside annular surface which is sized to surround a portion of said metallic plate at a location outside and surrounding said central opening;

providing a punch having a surface adapted to contact the generally flat upper surface;

providing a lifter having a surface adapted to contact a generally flat lower surface of the metallic plate which extends from the outside of the burred portion to the periphery die;

providing a knockout having a ring portion having a generally flat surface adapted to contact a front end (4) of the burred portion;

providing a central member (13, 38) having an outer annular surface adapted to fit inside the central opening and to contact an inside surface of the burred portion;

pressing the metallic plate between the punch and the lifter, while the ring portion of the knockout contacts the front end of the burred portion, the outer annular surface of the central member contacts the inside surface of the burred portion, and the inside annular surface of the periphery die contacts at least a portion of an outer perimeter of the metallic plate so as to re-shape the plate, while restricting lateral movement of the metallic plate by the pressing of the inside annular surface of the periphery die against the at least a portion of an outer perimeter of the metallic plate.

2. The method of shaping a burred portion of a metallic plate according to claim 1, further comprising the steps of at least partially punching a periphery of the metallic plate by pressing the metallic plate with the punch while an upper surface of the periphery die contacts an outer portion of the lower surface of the metallic plate such that a portion of the metallic plate outside of the inside annular surface of the periphery die is at least partially punched, and wherein the restricting of lateral movement is carried out during said step of at least partially punching.

3. The method of shaping a burred portion of a metallic plate according to claim 1, wherein said restricting of lateral movement is carried out after a perimeter portion of the metallic plate has been punched to a size such that the metallic plate fits within the periphery die.

4. The method of shaping a burred portion of a metallic plate according to claim 1, wherein said lifter is disposed inside said periphery die and is moved relative to said periphery die.

5. The method of shaping a burred portion of a metallic plate according to claim 4, wherein said knockout is disposed inside said lifter and a resilient means biases said knockout upward toward said punch relative to said lifter.

6. The method of shaping a burred portion of a metallic plate according to claim 1, wherein the central member having an outer annular surface adapted to fit inside the central opening and to contact an inside surface of the burred portion is provided as a pilot pin which extends downward from the punch.

7. The method of shaping a burred portion of a metallic plate according to claim 1, wherein the central member having an outer annular surface adapted to fit inside the central opening and to contact an inside surface of the burred portion is provided as a central member which extends upward from the knockout.

8. A method of working a burred portion comprising the steps of:

at least partially punching a periphery of a workpiece, which has already been subjected to burring, by a periphery punch and a periphery die; and further pressing the burred portion by said periphery punch and a die surface including an annular portion which opposes said periphery punch while restricting a lateral movement of the workpiece by said periphery die.

9. A method of working a burred portion according to claim 8, wherein said restricting the lateral movement of the workpiece by said periphery die is carried out during the step of punching the periphery of the workpiece.

10. A method of working a burred portion according to claim 8, wherein said restricting the lateral movement of the workpiece by said periphery die is carried out after the step of punching the periphery of the workpiece.

11. A method of working a burred portion comprising the steps of:

feeding into a periphery die a workpiece which has already been subjected to burring and a periphery of which has already been punched into a predetermined dimension; and pressing the burred portion by an upper punch and a die surface including an annular portion which opposes said upper punch while restricting a lateral movement of the workpiece by said periphery die.

12. An apparatus for working a burred portion comprising:

a metallic mold having a periphery die and a periphery punch which are arranged to at least partially punch a periphery of a workpiece which has already been subjected to burring;

a lifter which is disposed inside said periphery die so as to be movable up and down relative to said periphery die; and further working means for further working said burred portion into a shape and dimension to those of a final product of the workpiece while restricting a lateral movement of the workpiece by said periphery die.

13. An apparatus for working a burred portion according to claim 12, wherein said further working means comprises:

a pilot pin which is projectingly fixed to a lower end of said periphery punch; and a knockout which is disposed in a recess in said lifter so as to be movable up and down, said knockout having an annular portion on an upper edge thereof.

14. An apparatus for working a burred portion according to claim 13, wherein said knockout is received by resilient means which are disposed between a bottom end of said knockout and an upper end of said lifter.

15. An apparatus for working a burred portion according to claim 13, wherein said pilot pin has an outer diameter substantially equal to an inner diameter of the burred portion and wherein said annular portion has an inner diameter substantially equal to the outer diameter of said pilot pin and a thickness substantially equal to a thickness of the burred portion of the final product, an upper surface of said annular portion being arranged to pressingly receive a front end of the burred portion, whereby an annular space which has substantially a shape and dimension of the burred portion of the final product is formed by a side wall of said pilot pin, an inner surface of said lifter, the upper surface of said annular portion and a lower surface of said periphery punch.

16. An apparatus for working a burred portion comprising:

a metallic mold having a periphery die and an upper punch, said periphery die being arranged such that a workpiece, which has already been subjected to burring and a periphery of which has already been punched into a predetermined dimension, is fed thereinto;

a lifter which is disposed inside said periphery die so as to be movable up and down relative to said periphery die; and further working means for further working the burred portion into a shape and dimension of those of a final product of the workpiece while restricting a lateral movement of the workpiece by said periphery die.

17. An apparatus for working a burred portion according to claim 16, wherein said further working means comprises:

a pilot pin which is projectingly fixed to a lower end of said upper punch; and a knockout which is disposed in a recess in said lifter so as to be movable up and down.

18. An apparatus for working a burred portion according to claim 7, wherein said knockout is received by a spring which is disposed between a bottom end of said knockout and an upper end of said lifter.

19. An apparatus for working a burred portion according to claim 17, wherein said pilot pin has an outer diameter substantially equal to an inner diameter of the burred portion and wherein said annular portion has an inner diameter substantially equal to the outer diameter of said pilot pin and a thickness substantially equal to a thickness of the burred portion of the final product, an upper surface of said annular portion being arranged to pressingly receive a front end of the burred portion, whereby an annular space which has substantially a shape and dimension of the burred portion of the final product is formed by a side wall of said pilot pin, an inner surface of said lifter, the upper surface of said annular portion and a lower surface of said upper punch.

20. An apparatus for working a burred portion comprising:

a metallic mold having a periphery die and a periphery punch which are arranged to at least partially punch a periphery of a workpiece which has already been subjected to burring;

a lifter which is disposed inside said periphery die so as to be movable up and down relative to said periphery die; and a central member disposed inside said lifter, said central member comprising an upper cylindrical portion for receiving therethrough the burred portion of the workpiece and a peripheral annular portion having an upper flat surface for receiving thereon a front end of the burred portion such that further working of the burred portion can be carried out while restricting a lateral movement of the workpiece by said periphery die.

21. An apparatus for working a burred portion according to claim 20, wherein said lifter is received by resilient means which are disposed at a bottom end of said lifter.

22. An apparatus for working a burred portion according to claim 20, wherein said upper cylindrical portion of said central member has an outer diameter substantially equal to an inner diameter of the burred portion of a final product of the workpiece, and wherein said peripheral annular portion has a thickness substantially equal to the thickness of the burred portion of the final product, whereby an annular space which has substantially a shape and dimension of the burred portion of the final product is formed by a side wall of said upper cylindrical portion, the upper surface of said peripheral annular portion, an inner surface of said lifter and a lower surface of said peripheral punch.

23. An apparatus for working a burred portion comprising:

a metallic mold having a periphery die and an upper punch which are arranged to receive therein a workpiece which has already been subjected to burring and a periphery of which has already been punched into a predetermined dimension;

a lifter which is disposed inside said periphery die so as to be movable up and down relative to said periphery die; and a central member disposed inside said lifter, said central member comprising an upper cylindrical portion for receiving therethrough the burred portion of the workpiece and a peripheral annular portion having an upper flat surface for receiving thereon a front end of the burred portion such that further working of the burred portion can be carried out while restricting a lateral movement of the workpiece by said periphery die.

24. An apparatus for working a burred portion according to claim 23, wherein said lifter is received by resilient means which are disposed at a bottom end of said lifter.

25. An apparatus for working a burred portion according to claim 23, wherein said upper cylindrical portion of said central member has an outer diameter substantially equal to an inner diameter of the burred portion of a final product of the workpiece, and wherein said peripheral annular portion has a thickness substantially equal to the thickness of the burred portion of the final product, whereby an annular space which has substantially a shape and dimension of the burred portion of the final product is formed by a side wall of said upper cylindrical portion, the upper surface of said peripheral annular portion, an inner surface of the lifter and a lower surface of said upper punch.

* * * * *